United States Patent [19]

Repetto

[11] 4,253,318

[45] Mar. 3, 1981

[54] MACHINE FOR TRIMMING SKINS

[75] Inventor: Silvio Repetto, Modena, Italy

[73] Assignee: S.p.A. Luigi Rizzi & C., Modena, Italy

[21] Appl. No.: 78,223

[22] Filed: Sep. 24, 1979

[30] Foreign Application Priority Data

Sep. 29, 1978 [IT] Italy ..... 28277 A/78

[51] Int. Cl.[3] ..... C14B 1/14; B26D 7/06

[52] U.S. Cl. ..... 69/9.1; 69/13; 83/431

[58] Field of Search ..... 69/2, 9.1, 13, 21.5; 144/175; 83/401, 409, 425, 431

[56] References Cited

U.S. PATENT DOCUMENTS 2,107,634 2/1938 Johnston ..... 69/9.1

2,463,852 3/1949 Carnes et al. ..... 69/13

2,720,101 10/1955 Maubey ..... 69/9.1

*Primary Examiner*—Patrick D. Lawson

*Attorney, Agent, or Firm*—Kurt Kelman

[57] ABSTRACT

The present invention concerns a machine for clipping or trimming hides or skins of the type comprising cylinders with blades or the like for the calibration of hides, leather or the like skins, said machine being provided with devices of substantially electromechanical type for permitting continuous and automatic compensation of the wear on the blades during the process as well as for the necessary increases of thickness in the end portions of the hides under preparation, ensuring uniform calibration of the hides in conformity with the predetermined initial thickness values.

7 Claims, 3 Drawing Figures

MACHINE FOR TRIMMING SKINS

As is well known, hides, after dressing are clipped or trimmed on trimming machines, sometimes after splitting, for the purpose of obtaining skins of uniform thickness and for the removal of localised, undesirable blood clots or swellings. The trimming machines utilise the principle of passing the skins having variable initial thicknesses either from skin to skin, or at various points of the same skin, between two opposed cylinders having parallel axes, one cylinder of which has an opposing function and the other of which is provided with cutting blades of known type, disposed on the periphery in two co-axial spirals, but wound from the centre in opposite directions and each extending over half the length of the cylinder. In these types of machines, the bladed cylinder usually has a fixed axis, or is displaceable relative to the opposing roller only over small displacements, whilst the opposing roller is mounted radially displaceable relative to the bladed cylinder, the receding and approaching (opening—closing) movement of which being obtained by means of support levers pivoted on the frame of the machine and actuated by hydraulic units with a cylinder and piston or electromechanical units or the like.

Since the cutting edge of the blades is subjected to continuous wear during operation, grindstones are provided for contact with the blade itself, and constantly sharpen or whet the cutting edge. This sharpening action involves continuous, if only slight, wear on the blades themselves and, finally, a continuous reduction in the diameter of the bladed cylinder. Consequently, there is a continuous variation in the trimmed thickness, since the distance between the periphery of the opposing roller and the bladed cylinder varies.

In known machines, in order to compensate for the wear on the blades the bladed cylinder is mounted radially displaceable towards the opposing roller and for the adjustment and maintenance of the relative positioning between the cylinders to the predetermined thickness, generally complicated devices are used which, in practice, have not always proved to be fully satisfactory either for the mass of the members in movement or in that the sharpening apparatus has to run on carriages supported by guides and the unit has to be displaced for the compensation of the wear as a result of the bladed cylinder.

Therefore the object of the present invention is to provide a trimming machine or the like for split skins, said machine being improved so as to permit, by means of separate controls, the exact setting of the initial thickness between opposing roller and bladed cylinder, the constant compensation of the wear on the blades and consequent adjusted positioning of the fluted cylinder used for the separation of the hides from the bladed cylinder, as also the obtaining of the necessary increases in thickness that are required to correspond with the peripheral portions of the skin which has to be trimmed with different thicknesses.

A further object of the present invention is to provide a trimming machine or the like in order to advantageously exploit, both for the setting of the initial constant thickness and for the continuous increase in thickness and recovery of the wear on the blades, the same means of movement already utilised for the spacing of the opposing roller relative to the bladed cylinder, there being associated with said means of displacement, electromechanical devices of reliable operation, of high precision and of very limited bulk.

A further object of the present invention is to provide a trimming machine able to offer constantly direct visualisation (viewing) of the amounts or thicknesses of the work, both at the beginning and subsequently, as well as increases and the algebraical amount thereof, effected during the process.

These objects and advantages are obtained by a trimming machine with a bladed cylinder or the like for split skins, leather or the like, of the type hitherto comprising a bladed cylinder associated with a grindstone for the continuous whetting of the blades themselves and opposed to an opposing roller mounted radially displaceable relative to the bladed cylinder by means of levers, pivoted on the frame and actuated by hydraulic piston units, with which bladed cylinder there is also associated an axially rotatable fluted roller, for detaching the processed hides from the bladed cylinder; said machine, according to the present invention, comprising:

a bladed cylinder rotatable about a fixed axis on the frame of the machine;

a fluted roller, driven by its own motor, having the support shaft mounted to rotate on two end supports which in turn are radially displaceable relative to said bladed cylinder by means of pairs of gears of helicoidal gear and endless screw type which are associated with a first control shaft actuated by means of a crank or motor in order to achieve the initial position of the fluted roller in line with the blades;

by at least one magnetic, optical or the like, sensor, connected to a support of said first shaft of said roller and positioned initially in line with said blades; sand sensor being capable of actuating, with each predetermined reduction of the diameter of the bladed cylinder as a result of whetting, a motor, connected by a magnetic clutch or the like coupling with said first support-bearing shaft of the fluted roller in order to automatically produce the positioning thereof in line with the blades as a consequence of the wear thereon; there also being provided, for obtaining the constant initial thickness between the opposing roller and bladed cylinder and for the increases in thickness during the process;

a second control shaft positioned in parallel with the axis of rotation of the levers actuating the opposing roller and connected to said principle motor with the interposition of magnetic clutches and electromagnetic brake, on said second shaft there being keyed endless screws positioned to correspond with said two levers carrying the opposing roller and in engagement with helicoidal wheels which axially actuate a screw stop which abuts against the hydraulic valve box connected to said lever bearing the opposing roller, and hydraulically connected to said units actuating the levers themselves, so as to obtain, when controlled by the sensor and by means of said principle motor, the intervention of the hydraulic units and hence a radial displacement closing the opposing roller in order to keep constant the initial cutting thickness following the wear on the blades, there being associated with said second shaft a crank, motor or the like means for the manual or driven positioning of the initial cutting thickness, whilst in order to achieve the increases in thickness during the process, there is provided a hydraulic unit at one end of said second shaft having a plurality of co-axial pistons, preferably three, in order to impart, at the control of the operator, different axial displacements and of increasing value, predetermined on the shaft itself so as to obtain, by means of said endless screws and helicoidal gears, corresponding increases in the opening of the opposing cylinder; said machine finally comprising an electronic visualising device for the initial thicknesses and of the subsequent ones and connected to a pulse emitter associated with said second shaft, capable of achieving the algebraical sum of the variations in thickness.

The structural and functional characteristics of a trimming machine associated with the present invention will now be described in greater detail, according to a preferred, but not exclusive embodiment, with reference to the accompanying drawings, given merely by way of example and not as a limitation, wherein.

The machine according to the present invention includes substantially known parts and incorporates therein, exploiting in particular the movements of its principle parts, improved devices combined according to the invention.

Figure 1:
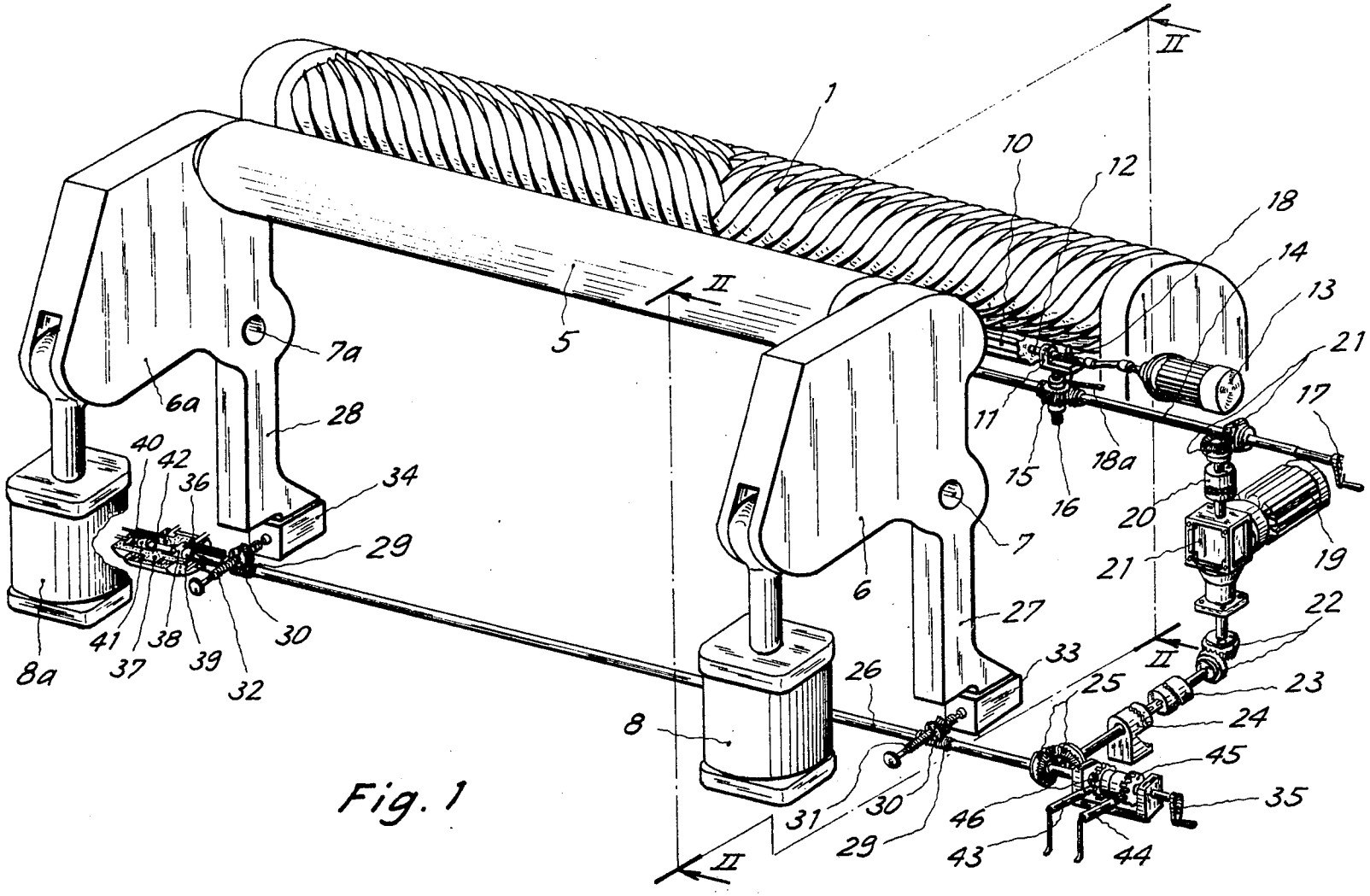
FIG. 1 is a perspective view of the principle part of a trimming machine.
Figure 2:
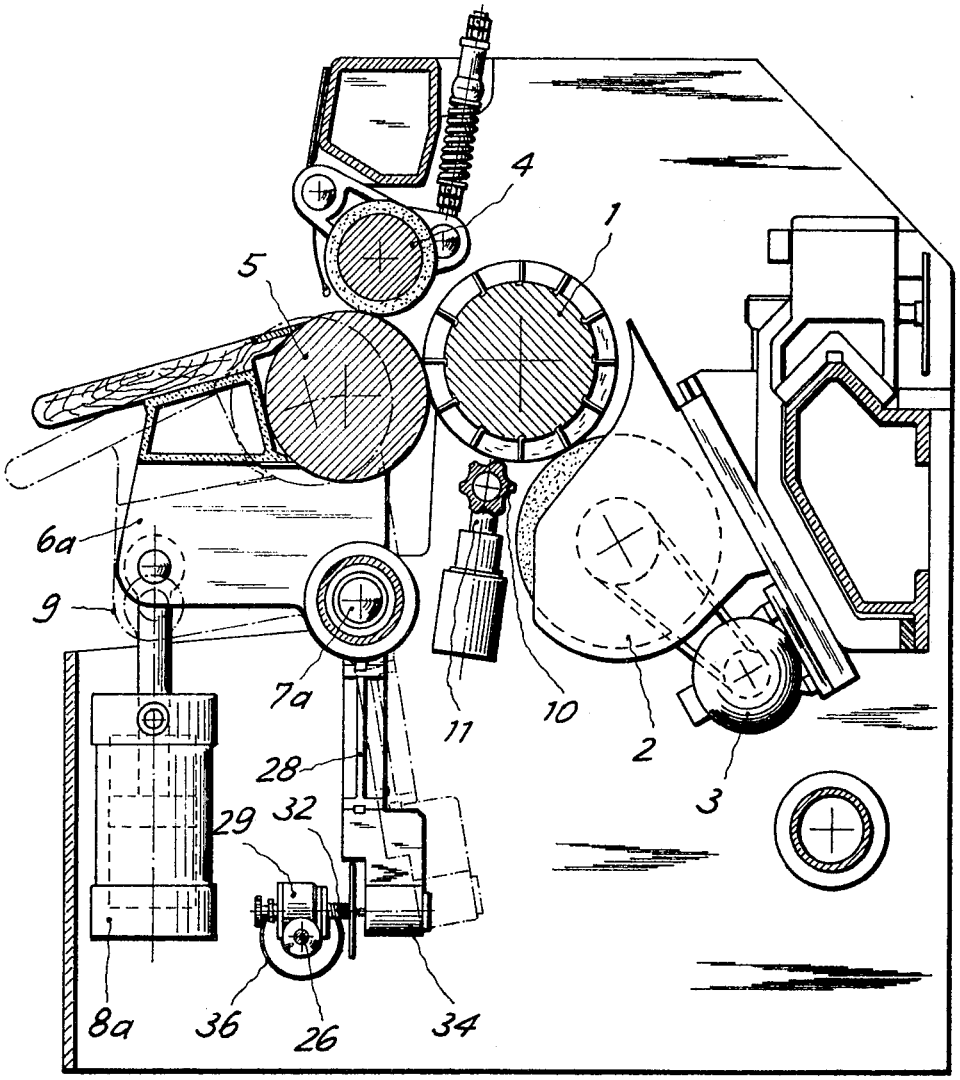
FIG. 2 is a cross-section of the same machine taken on the line II—II of FIG. 1.

As shown in FIGS. 1 and 2, the main part of the trimming machine comprises a bladed cylinder 1 and a whetting device 2 actuated by its own motor 3 associated with cylinder 1. The hide or skin is introduced along the line A of FIG. 2 between a pressure roller 4 and a contrast or opposing roller 5 and causing removal of the opposing roller 5 from the bladed roller and subsequently closed to a perdetermined distance from the bladed cylinder itself, i.e. to the space which represents the initial cutting thickness.

The opposing roller 5, for achieving opening and closing with roller 4, is mounted to swing on two opposing levers 6, 6*a* pivoted respectively on 7, 7*a* and caused to pivot about said pivots under the action of two hydraulic piston and cylinder units 8, 8*a*—the stem of which produces a limited rotation of the levers, as shown by the chain-dotted lines 9 in FIG. 2. A fluted roller 10 is also provided and represented by an axially fluted roller located in line with the blades and having the function of detaching the skin from the bladed cylinder after the trimming operation.

The machine according to the present invention comprises the bladed cylinder 1, secured to the support frame, and rotatable about an axis, whilst the movements of the opposing roller 5 are effected either by the opening and closing or by the setting to the initial constant thickness, or by increases of thickness and for the continuous compensation of the wear on the blade due to sharpening.

For this purpose, the machine which is the object of the present invention has two supports 11 (only one of which is shown in the drawings) radially displaceable towards and away from the bladed cylinder 1, and having the ends of a shaft 12 carrying fluted roller 10 rotatably mounted thereon.

The fluted roller 10 is driven by its own motor 13 (FIG. 1). The displacements of the supports 11 are achieved by means of a first shaft 14 bearing, in correspondence with the supports 11, a helicoidal endless screw and wheel couple 15 actuating a threaded pivot 16 connected to the base of the support 11.

A crank 17 is keyed on the end of the shaft 14 and by the action of said crank the endless screws and helicoidal couple axially displace the respective threaded pivot 16 and hence the supports 11. The initial position of the fluted roller in line with the blades is achieved manually by means of this crank 17.

The supports 11 are provided with a sensor 18 which may be of magnetic, optical or other type and which is positioned in line with the blades and connected by means of electrical or the like apparatus, to a principle motor 19. This motor 19 is kinematically connected by way of a magnetic clutch and conical couple 21, to the shaft 14 and therefore rotation thereof displaces the supports of the fluted roller 10. Consequently, with a reduction in the diameter of the bladed cylinder 1, of predetermined amount, due to wear thereon, the sensor 18 transmits a signal by way of the cable 18*a* to a known device which causes the motor 19 to rotate and engage the clutch 20. The motor 19 thus rotates the shaft 14 proportionally (by means of reduction 21, clutch 20, conical couple 21 until the supports 11 and hence the sensor and the fluted shaft 10 are turned to the position established relative to the bladed cylinder 1. From the reduction 21 of the motor 19 a chain of transmission is derived and represented by a conical couple 22, an electromagnetic joint 23 and an associated electromagnetic brake 24, and a final conical couple 25. The couple 25 is keyed on a control shaft 26 which is rotatable about an axis parallel to the common axis of rotation of the hinges 7, 7*a* of the levers 6, 6*a*, carrying the opposing roller 5. Two endless screws and associated helicoidal wheel 29, 30 are keyed on the shaft 26 and correspond to two extensions 27 and 28 of the levers 6, 6*a*. A threaded pivot or screw stop 31 and 32 respectively is provided axially of the helicoidal wheels and extends perpendicularly to the base of the extensions 27 and 28 and associated with a box of a hydraulic valve (not shown in the drawings) enclosed in the base 33 and 34 of said extensions 27, 28.

The hydraulic valves actuated by the axial displacements of the threaded studs 31, 32 are in turn connected hydraulically to the cylinder and piston units 8, 8*a* which actuate the levers 6, 6*a* bearing the opposing roller 5.

A crank 35 is keyed on one end of the shaft 26 and by the action of which crank are obtained, by the action of the rotation of the shaft 26 and the associated helicoidal wheels, axial displacements in two directions of the threaded pivots 31, 32 and hence an actuation of the hydraulic valves —the latter, in turn, cause the intervention of the hydraulic units 8, 8*a* which rotate the levers 6, 6*a* about the hinges 7, 7*a* producing displacements of the opposing roller 5 in one direction or the other. The relative position of the cylinders 1 and 5 is thus produced manually by means of this lever, that is to say the initial constant cutting thickness is set. This setting may also be effected by means of the motor 19 which can control the shaft 26 without actuating the shaft 14 by disengaging the joint 20 and engaging the clutch 23.

When the sensor 18 determines a reduction in the diameter of the bladed cylinder 1 it actuates the motor 19 to return, as already stated, the fluted roller 10 in line with the blades and it also causes the clutch 23 to close and frees the brake 24 whereby the motor 19 rotates the shaft 26 and the latter, by means of said hydraulic valves, consequently causes intervention of the hydraulic units 8, 8*a* which close the roller 5 automatically resetting the initial cutting thickness therefore with every intervention of the sensor 18.

The machine also comprises a device for obtaining the increase in the cutting thickness, as required during the processing of the peripheral parts of the skins which are generally trimmed to a thickness different from that of the central part.

This device comes into action at the command of the operator relative to the types of skins being processed. The device which is provided to obtain an increase or decrease in the cutting thickness relative to the initial thickness, comprises a hydraulic unit having multiple cylinders and pistons, co-axially connected to the free end of the shaft 26 (FIG. 1). More precisely, said unit is constituted by a fixed outer cylinder 36 within which a piston is displaceable and said piston is hollow and divided into two chambers in order to provide a cylinder 38 for a piston 39 axially connected to the shaft 26 and a cylinder 40, co-axial with the foregoing and within which a piston 41 is provided; the stem 42 of piston 41 penetrating into the chamber or cylinder 38, so as to represent a displaceable stop for the piston 39 co-axial therewith.

The co-axial cylinders 36, 38, 40 are provided with inlets and outlets for a pressurised fluid and there is provided a complete path displacement for all the pistons i.e. no stops in an intermediate position.

With such an arrangement and by dimensioning the paths of the three pistons, it is possible to obtain axial displacement of the shaft 26 without rotation and which displacements rotate the wheels 30 and hence axially displace the screws 31, 32 finally controlling the valves within the extensions 33, 34 for obtaining displacements of the roller 5 proportional to the paths of the pistons—said paths being different from each other in order to permit different increases and equal to the sum of the displacements of two pistons or of all three or also of only one.

Figure 3:
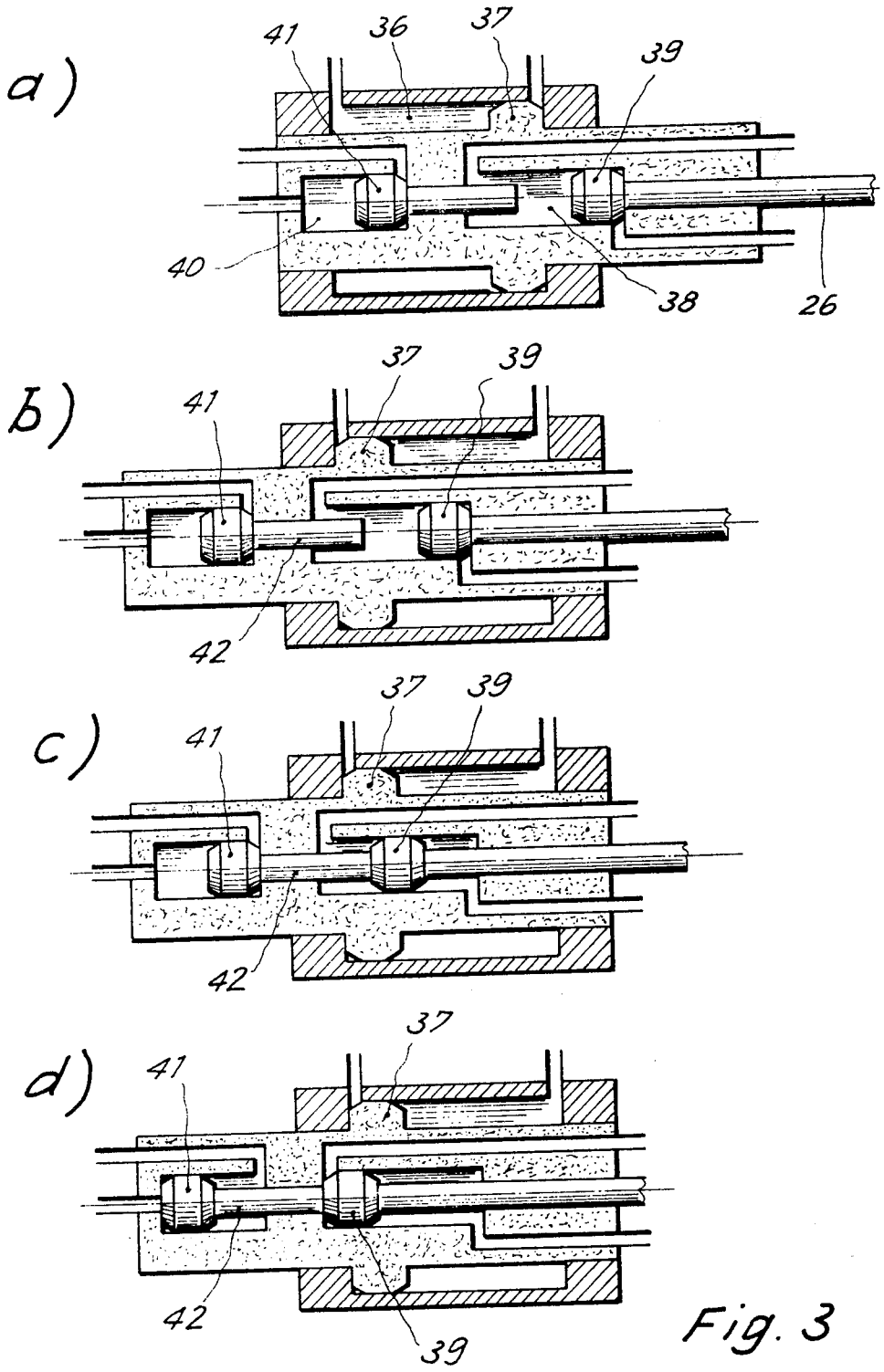
FIG. 3 comprises schematic illustrations of four successive operating positions (indicated by a, b, c and d) of a hydraulic device forming part of the invention having a plurality of pistons and being capable of producing skins of an increased cutting thickness.

By way of example, FIG. 3 shows the relative position of the three co-axial pistons for obtaining increases equal to multiples of 1/10 mm for example of 3/10 mm (position b), of 4/10 mm (position c) and 5/10 mm (position d).

In the said FIG. 3, the position (a) shows the position of the pistons in the resting phase and therefore in the starting phase. In this case all the pistons are at the end of the movement to the right. By actuating the piston 37, displacing it to the end of the left (position b), the shaft 26 is then displaced to the left of all the corresponding respective movements, for example, to 3/10 mm. If the piston 39 is then actuated, it is displaced to the left, stopping against the stem 42 of the piston 41 (position c) and if this movement is for example equal to ⅓ of the movement of the piston 37, it corresponds to a displacement of 1/10 mm. The shaft 26 will have been displaced to the left completely by 3/10 due to the piston 37 and by 1/10 due to the piston 39. By actuating the piston 41 to the left there is then obtained the displacement of the stop 42 (position d) whereby the piston 39 may again effect a subsequent displacement, for example, corresponding to another 1/10 mm. The shaft 26 is thus displaced for a corresponding movement to a total of 5/10 mm on the roller 5. By displacing the different pistons at various times it is possible to obtain displacements of the opposing roller 5 always between 1/10 mm and 5/10 mm. The movements of the shaft 26 are associated with a differential pulse emitter, for permitting, by means of a visualiser of known type (not shown), the direct and constant control of the values of the initial thickness set, of the successive increases automatically imparted to compensate for the wear on the blades, as well as those of the increases or decreases in thickness imparted by the operator during the process by means of the motor 19. The differential pulse emitter is indicated in FIG. 1 and comprises its own scanners or key buttons 43, 44 in contact with two toothed wheels 45, 46, co-axial with the shaft 26 and connected thereto by means of a free detent kinematic mechanism or the like, in such manner that a wheel can rotate together with the shaft only in one direction and in the other direction only when the shaft turns in the opposite direction. The differential pulse emitter has the task of adding and subtracting the variations in thickness imparted, by means of the motor 19 or the crank 35, to the opposing roller 5. A displacement of known amount of the roller 5 corresponds with each pulse and this displacement is displayed in known manner.

The operation of the machine is therefore as follows: with the machine stopped, the fluted roller 10 and the sensor 18 are brought in line with the blades by acting on the wheel 17—the clutch 20 being disengaged and motor 19 being stopped. By means of the crank 35, the position of the screws 31, 32 is regulated so that, by acting on the hydraulic units **8, 8*a* the roller 5 brushes over the bladed cylinder 1 and sets the visualiser at zero. By actuating the crank 35 (with the clutch 23 and the brake 24 disengaged) or by controlling with suitable push-buttons the motor 19 disengaging of the clutch 20 and brake 24 and engaging of the clutch 23, the shaft 26 the motor 19 rotates and displaces the screw studs (or stops) 31, 32 which actuate the hydraulic units 8, 8*a* by means of the hydraulic valves 33, 34. These units therefore remove the cylinder 5 from the bladed cylinder by a radial distance equal to the value of the initial cutting thickness previously established on the basis of the type of hide or skin to be processed. This distance is visualised by means of pulses caused by the rotation of the shaft 26**.

The skins are then introduced between the cylinders according to the usual method and the processing is begun by starting the motors of the cylinders 1 to 5 and 10. Since the blades become worn on account of continuous whetting during the treatment, the sensor 18, as already stated, determines the reduction in the diameter of the bladed cylinder and, when this reduction has reached a given value, the sensor actuates the motor 19 and simultaneously closes the clutches 20, 23 and frees the brake 24. The motor 19 then rotates the shafts 14 and 26, the first of which returns the fluted roller and the sensor in line with the blades and the second one displaces the screw stops 31, 32 which produce the intervention of the hydraulic units **8, 8*a***.

The latter rotate the levers 6 and **6*a* which displace the roller 5 stopping it in the position, relative to the bladed cylinder, of initial thickness at the moment in which the sensor 18 interrupts the feed of the principle motor 19** upon reaching its position in line with the blades.

In order to obtain increases in thickness (when for example the skins are with their end portions in the cutting position, the operator supplies fluid pressure to the co-axial piston cylinders. By regulating the intervention of one or more than one or of all, according to the value of the increase in thickness required by the specific process, the partial or total intervention of said co-axial pistons axially displaces the shaft 26 which, as already stated, causes the intervention of hydraulic units 8, 8*a* which in turn increase or decrease the distance of the roller 5 relative to the value of the initial thickness. The operator can discover all details set both automatically and manually on the viewing device.

I claim:

1. A trimming machine comprising a bladed cylinder or the like of the type having the bladed cylinder placed against an opposing roller radially displaceable relative to the bladed cylinder by means of levers actuatable by cylinder and hydraulic piston units comprising a fluted roller rotatable in line with said blades, characterised in that it comprises said bladed cylinder mounted to rotate about a fixed axis and said fluted roller mounted on two end supports in turn displaceable radially relative to the bladed cylinder by means of helical gear wheels and endless screws, which gears are associated with a first control shaft actuated by means of a crank or motor in order to achieve the initial position of the fluted roller in line with the blades; there being provided at least one sensor means, connected to a support of the shaft of the fluted roller and initially positioned in line with the blades; said sensor being able to actuate, with each pre-determined reduction in the diameter of the bladed cylinder resulting from wear, a motor connected by means of a magnetic or the like clutch to said first support carrying shaft of the fluted roller, so as to achieve once more the position of the fluted roller in line with the blades; there also being provided, in order to achieve the constant initial thickness between the opposing roller and the bladed cylinder and for the increases in thickness during the process, a second control shaft positioned in parallel with the axis of rotation of the levers actuating the opposing roller and connected to said principle motor with inter-position of magnetic clutches, there being keyed on said second shaft endless screws positioned to correspond with the levers carrying the opposing roller and in engagement with helical gears which axially actuate a screw stop associated with the box of a hydraulic valve connected to said levers carrying the opposing roller and acting on said hydraulic units which control the levers, so as to produce, upon the command of the sensor and by way of said motor, the intervention of the hydraulic units actuating the levers and hence a radial displacement closing the opposing roller in order to keep constant the initial cutting thickness also following wear on the blades; there being a crank or motor associated with said second shaft for the manual or driven position of the initial cutting thickness whilst there is provided, in order to achieve increases in thickness a hydraulic unit at one end of said second shaft and having a plurality of coaxial pistons, for imparting, upon the control of the operator, different axial displacement of pre-determined increasing value of the shaft itself so as to obtain corresponding increases in the opening of the opposing roller; there finally being provided an electronic visualising device for the initial and subsequent thicknesses, and also a differential pulse emitter associated with said second shaft, for obtaining the algebraical sum of the increases in thickness effected.

2. A machine according to claim 1, wherein said boxes and associated hydraulic valves, actuated by said screw stops, are positioned on the base of extensions or additions of the operating levers of said opposing roller.

3. A machine according to claim 1 or 2, wherein there is provided in the kinematic chain at least one electromagnetic brake or the like for the stable locking of the regulating unit of the thickness given by the position of the opposing roller after each closing or opening displacement thereof.

4. A machine according to claim 1 or 2, wherein said co-axial multi-piston unit is formed by a fixed cylinder with a hollow internal piston axially divided into two cylindrical chambers containing two opposing pistons, one of which pistons is axially connected to the control shaft of the hydraulic valves and the other piston displaceable, with a pre-determined path and so as to represent a stop for the movement of the piston associated with the shaft; the path of said pistons and their successive intervention, with consequent axial displacement of the shaft and associated rotation of the levers, being produced by the operator on the basis of the desired values of increase in thickness.

5. A machine according to claim 1 or 2, wherein said sensor or sensors are electrically connected to devices for causing the intervention of said motor and closing said magnetic clutches for the time necessary both for resumption of the position in line with the blades of the sensors themselves and of the fluted roller, and also for displacing the opposing roller until resuming the initial cutting thickness dependently on the wear on the blades

6. A machine according to the claim 1 or 2, wherein said emitter of differential pulses is associated with said second shaft actuating the hydraulic valves by means of two toothed wheels rotatable with the shaft itself each only in one direction—the pulses being computed by means of said wheels being algebraically added and the values continuously transmitted to said visualiser.

7. A machine as claimed in claim 1, wherein said second shaft can be controlled, for the initial position of the cutting thickness, by the same motor which maintains the constant cutting thickness by disconnecting from the movement the said first shaft and connecting it to the said second shaft associated with said hydraulic positioning valves of said opposing roller.

* * * * *